US006488533B1

(12) United States Patent
Thompson et al.

(10) Patent No.: US 6,488,533 B1
(45) Date of Patent: Dec. 3, 2002

(54) DEVICES FOR PROTECTING NETWORK EQUIPMENT FROM ELECTROSTATIC DISCHARGE EMANATING FROM NETWORK CABLES

(75) Inventors: Geoffrey O. Thompson, Mountain View, CA (US); Steven Carlson, Portland, OR (US); Richard F. Brooks, Palo Alto, CA (US)

(73) Assignee: Nortel Networks Limited, St. Laurent (CA)

( * ) Notice: Subject to any disclaimer, the term of this patent is extended or adjusted under 35 U.S.C. 154(b) by 0 days.

(21) Appl. No.: 09/752,972

(22) Filed: Dec. 29, 2000

(51) Int. Cl.[7] ..... H01R 31/08

(52) U.S. Cl. ..... 439/509; 439/188; 439/924.1; 439/931

(58) Field of Search ..... 439/507–514, 439/181, 924.1, 931, 148, 149, 135, 180, 188; 361/212

(56) References Cited

U.S. PATENT DOCUMENTS 4,231,901 A * 11/1980 Berbeco ..... 252/511
5,041,319 A * 8/1991 Becker et al. ..... 428/71
5,222,899 A * 6/1993 Hulderman ..... 439/141
5,629,628 A * 5/1997 Hinds et al. ..... 324/628
5,910,878 A * 6/1999 Mello et al. ..... 361/212
5,947,773 A * 9/1999 Karam ..... 439/676

* cited by examiner

*Primary Examiner*—Gary F. Paumen
*Assistant Examiner*—James R. Harvey
(74) *Attorney, Agent, or Firm*—Blakely Sokoloff Taylor & Zafman LLP

(57) ABSTRACT

A protective cap and method therefor for preventing the build-up of electrostatic charges on network communications cables and also for protecting the cable ends and connectors from physical abuse. The protective cap comprises a socket housing for receiving a connector of a network communications cable that has a plurality of wire mediums, and a shorting electrical conductor to electrically connect together the wire mediums when the connector is received in the socket housing. The build-up of electrostatic charges on the cable wire mediums is prevented by the shorting electrical conductor electrically connecting the wire mediums together. The network communications cable is protected from physical abuse by the socket housing at least partially enclosing the cable connector. A network equipment connector is also disclosed that causes the discharge of electrostatic charges on a network cable as the cable is being mated with the equipment connector.

5 Claims, 3 Drawing Sheets

DEVICES FOR PROTECTING NETWORK EQUIPMENT FROM ELECTROSTATIC DISCHARGE EMANATING FROM NETWORK CABLES

FIELD OF THE INVENTION

This invention relates generally to computer networking, and in particular, to a protective cap that connects to a connector of an Ethernet communications cable to prevent the accumulation of electrostatic charges on the cable which may damage network equipment during hook-up, and also to prevent physical damage to the cable connector during handling.

BACKGROUND OF THE INVENTION

Local area networks (LANs) have grown tremendously in the last few years. And, leading the way in the growth of LANs is the Ethernet type LAN. Ethernet was first developed in the mid 1970s. By the early 1980s, the Institute of Electrical and Electronic Engineers (IEEE) developed a standard for Ethernet designated as IEEE 802.3, which has been universally adopted by the network industry. From the early 1980s until the present, the IEEE 802.3 standard has undergone many revisions, including the addition of new features such as switched Ethernet, Fast Ethernet, Gigabit Ethernet, and others. The present invention relates to the newest communications cables for Ethernet networks, namely categories 5*e,* 6 and higher performance cables specified by the TIA 568 and ISO/IEC 11801 standards.

The new Ethernet communications cables specified in categories 5*e* and 6 have several advantages over cables specified in categories 1 through 4. Namely, categories 5*e* and 6 cables are capable of higher bandwidths, have improved insulating dielectrics, and better conductivity. One drawback of these cables is that they tend to accumulate electrostatic charges fairly easy. For example, when these cables are handled, dragged, and routed through building walls, they accumulate relatively large amounts of electrostatic charges, resulting in voltages as high as six (6) kilo-volts (KV). When such a cable is subsequently connected to a network equipment, the electrostatic charges on the cable discharge through the network equipment generating a relatively high current pulse. This relatively high current pulse can cause damage to the network equipment.

Another drawback of these cables and the connectors at the ends of the cables is that they can be subject to lots of physical abuse. This can occur during transportation, handling, and routing through walls and other conduits, etc. A damaged cable or connector can make a network equipment inoperable, or be a source of errors for the network.

Thus, there is a need for an apparatus and method of protecting a communications cable against the build-up of electrostatic charges. There is also a need for an apparatus and method of protecting a cable and its connectors from physical damage. Such needs are met herein with the protective cap and method therefor of the invention.

SUMMARY OF THE INVENTION

An aspect of the invention relates to a protective cap and method therefor for preventing the build-up of electrostatic charges on a network communications cable and also for protecting the cable ends and connectors from physical abuse. The protective cap comprises a socket housing for receiving a connector of a network communications cable that has a plurality of wire mediums, and a shorting electrical conductor to electrically connect together the wire mediums when the connector is received in the socket housing. The build-up of electrostatic charges on the cable wire mediums is prevented by the shorting electrical conductor electrically connecting the wire mediums together. The network communications cable is protected from physical abuse by the socket housing at least partially enclosing the cable connector.

In the exemplary embodiment, the protective cap is designed to be used with category 5*e,* 6 or higher network communications cable as specified in ISO/IEC 11801 standard typically used in Ethernet network systems. Accordingly, the protective cap is configured as a RJ45 female socket housing as specified in IEC 60603-7 since these types of network communications cables typically use an 8-pin modular plug/jack as specified in IEC 60603-7, commonly known as an RJ45 connector. At least the cavity of the socket housing may be formed of a molded Styrofoam with an electrically conductive filler. When the cable connector is inserted into the cavity, the cavity deforms and the conductive filler makes electrical contacts to the wire mediums of the communications cable. Alternatively, at least the cavity of the socket housing may be formed of a plastic material having metallized pins designed for register fit with the RJ45 plug contacts. Each of these embodiments electrically connect together the cable wire mediums, which are twisted pairs of insulated wires for categories 5 and 6 cables. Other aspect of the invention relates to a combination network communications cable having such protective caps at their respective ends.

Another aspect of the invention relates to an electrostatic protected connector that causes, the discharge of electrostatic charges on a network communications cable as the cable connector is being mated with the electrostatic protected connector. The electrostatic protected connector comprises at least a partially electrical conducting housing having a cavity configured to receive a corresponding network cable connector. The electrostatic protected connector includes one or more contacts to make electrical connection with one or more corresponding contacts of the corresponding network cable connector to electrically connect a network equipment hardware to the cable wire mediums. The electrostatic protected connector further includes one or more electrostatic discharge contacts with paths to ground potential to make contact with the one or more contacts of the corresponding network cable in order to discharge electrostatic charges on the cable wire mediums prior to them making electrical connection with the network hardware equipment.

Other aspects, features, and techniques of the invention will become apparent to those skilled in the relevant art in view of the following detailed description of the invention.

DETAILED DESCRIPTION OF THE INVENTION

Figure 1:
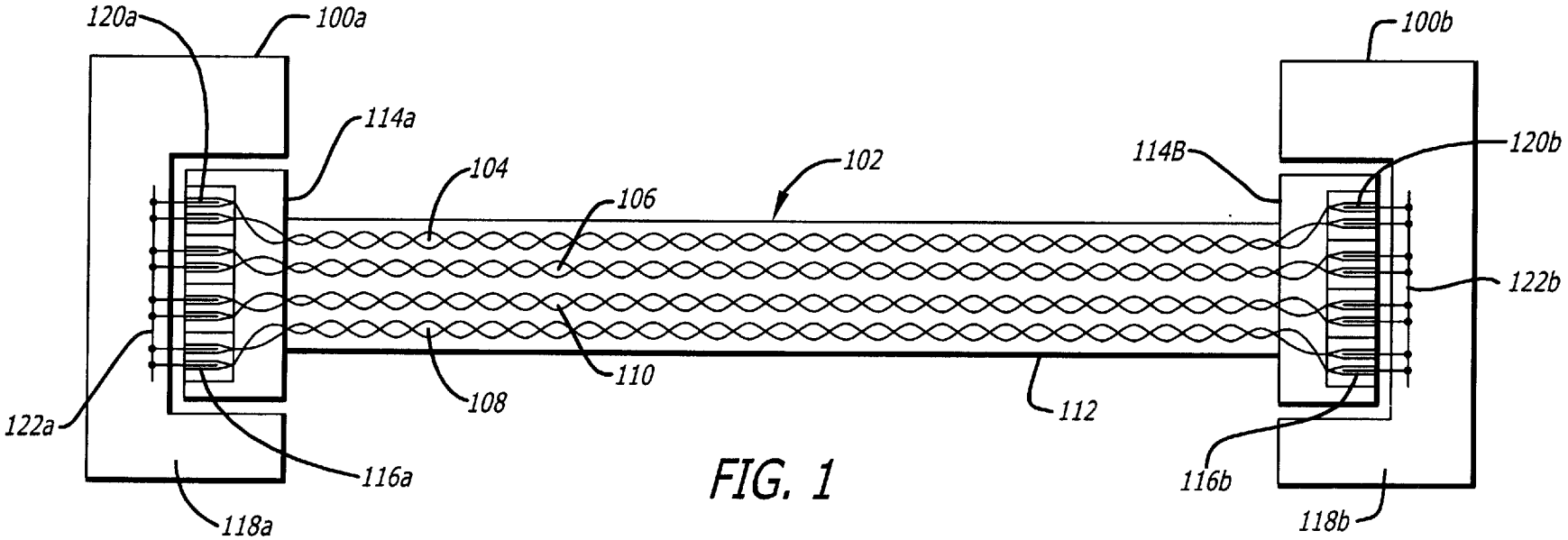
FIG. 1 illustrates a diagram of a pair of exemplary protective caps in accordance with the invention connected to respective connectors of a network communications cable.

FIG. 1 illustrates a diagram of a pair of exemplary protective caps 100*a–b* in accordance with the invention connected to respective connectors 114*a–b* of an exemplary network communications cable 102. The exemplary communications cable 102 may be of the type specified as category 5*e,* 6 or higher in accordance with ISO/IEC 11801 standard. Accordingly, the communications cable 102 may comprise one or more twisted pairs of insulated wires 104, 106, 108 and 110 extending from an end to an opposite end of the cable 102. The communications cable 102 further comprises a jacket 112 for enclosing and protecting the twisted wire pairs 104, 106, 108 and 110. The cable 102 may also include a central cord (not shown) for-providing better resiliency for the cable 102.

The network communications cable 102 may further include a pair of connectors 114*a–b* at each of its respective ends. If the communications cable is a category 5*e* or 6, the connectors 114*a–b* may be an 8-pin modular plug/jack as specified in IEC 60603-7, commonly known as an RJ45 connector which comprises a plurality of pins 116*a–b* respectively connected to the ends of the twisted wire pairs 104, 106, 108 and 110.

As previously discussed, one drawback of these cables is that they tend to accumulate electrostatic charges fairly easy. For example, when these cables are handled, dragged, and routed through building walls, they accumulate relatively large amounts of electrostatic charges, resulting in voltages as high as six (6) kilo-volts (KV). When such a cable is subsequently connected to a network equipment, the electrostatic charges on the cable discharge through the network equipment generating a relatively high current. This relatively high current can cause damage to the network equipment. Yet, another drawback of these cables and the connectors at the ends of the cables is that they can be subject to lots of physical abuse. This can occur during transportation, handling, routing through walls and other conduits, etc. A damaged cable or connector can make a network equipment inoperable, or be a source of errors for the network.

The protective caps 100*a–b* of the invention prevent the build-up of electrostatic charges on these cables, and also protect the cable ends and connectors from physical abuse. More specifically, the protective caps 100*a–b* comprise respectively socket housings 118*a–b* for receiving respectively therein the cable connectors 114*a–b*. If the cable connectors 114*a–b* are of the RJ45 type, the socket housings 118*a–b* may have a cavity physically compliant with the RJ45 female socket specified in IEC 60603-7. The protective caps 100*a–b* further comprise respectively a plurality of pins 120*a–b* for electrical connection to corresponding pins 116*a–b* of connectors 114*a–b*. The protective caps 110*a–b* also comprises shorting electrical conductors 122*a–b* for electrically connecting the respective pins 116*a–b* together. In the exemplary embodiment, at least the cavity of the socket housing may be formed of a molded Styrofoam with an electrically conductive filler. When the cable connector is inserted into the cavity, the cavity deforms and the conductive filler makes electrical contacts to the wire mediums of the communications cable. Alternatively, at least the cavity of the socket housing may be formed of a plastic material having metallized pins designed for register fit with the RJ45 plug contacts. Each of these embodiments electrically connect together the cable wire mediums, which are twisted pairs of insulated wires for categories 5 and 6 cables.

The shorting or electrical connection of the ends of the cables 102 prevents the build-up of electrostatic charges on the cables. Thus, a network installer can handle, transport and route the cable through walls with the protective caps on each of the ends to prevent the build-up of electrostatic charges. When the cable is in place for connection to the corresponding network equipment, the caps are removed and the cable connectors are connected to the corresponding equipment. Since essentially there is no build-up of electrostatic charges on the cable, the network equipment is saved from being damaged from electrostatic discharge. The socket housing protects the cable connectors and cable ends from physical abuse during transportation, handling and routing through walls and other conduits. The protective cap of the invention need not be limited to use with categories 5*e* and 6, but may be used to protect other types of network cables.

Figure 2:
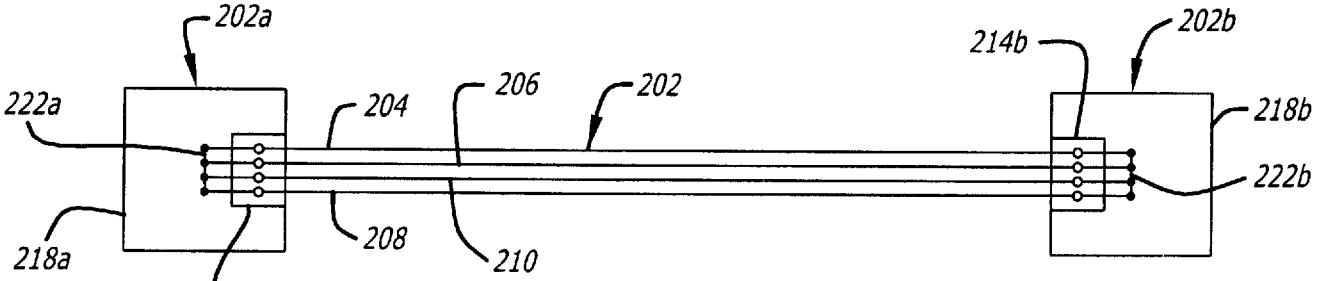
FIG. 2 illustrates a schematic diagram of a pair of exemplary protective caps in accordance with the invention connected to respective connectors of a network communications cable.

FIG. 2 illustrates a schematic diagram of a pair of exemplary protective caps 202*a–b* in accordance with the invention at respective ends of a network communications cable 202. As previously discussed, the protective cap of the invention need not be limited to use with categories 5*e* and 6, but may be used to protect other types of network cables. Schematically represented, the protective caps 202*a–b* comprise respectively socket housings 218*a–b* for receiving and protecting from physical abuse the corresponding cable connectors 214*a–b*. Also schematically represented, the protective caps 202*a–b* comprise respectively shorting electrical conductors 222*a–b* for electrically connecting the wire mediums 204, 206, 208 and 210 together, thereby preventing the build-up of electrostatic charges on the wire mediums 204, 206, 208 and 210.

Figure 3A:
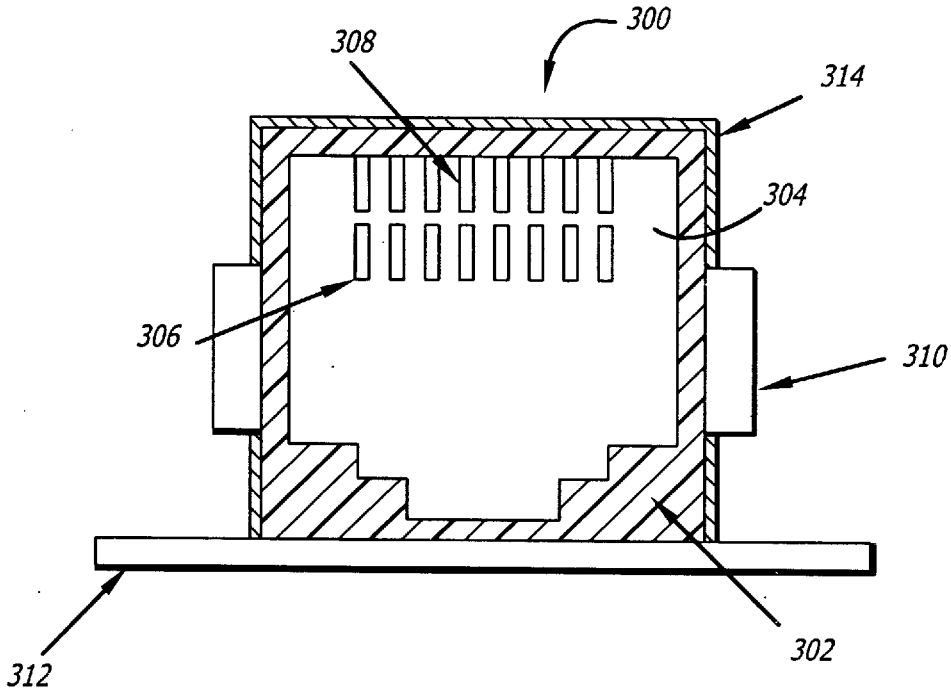
FIGS. 3A–B illustrate front and side views (with cut away view to show contacts) of an exemplary electrostatic protected connector in accordance with the invention.
Figure 3B:
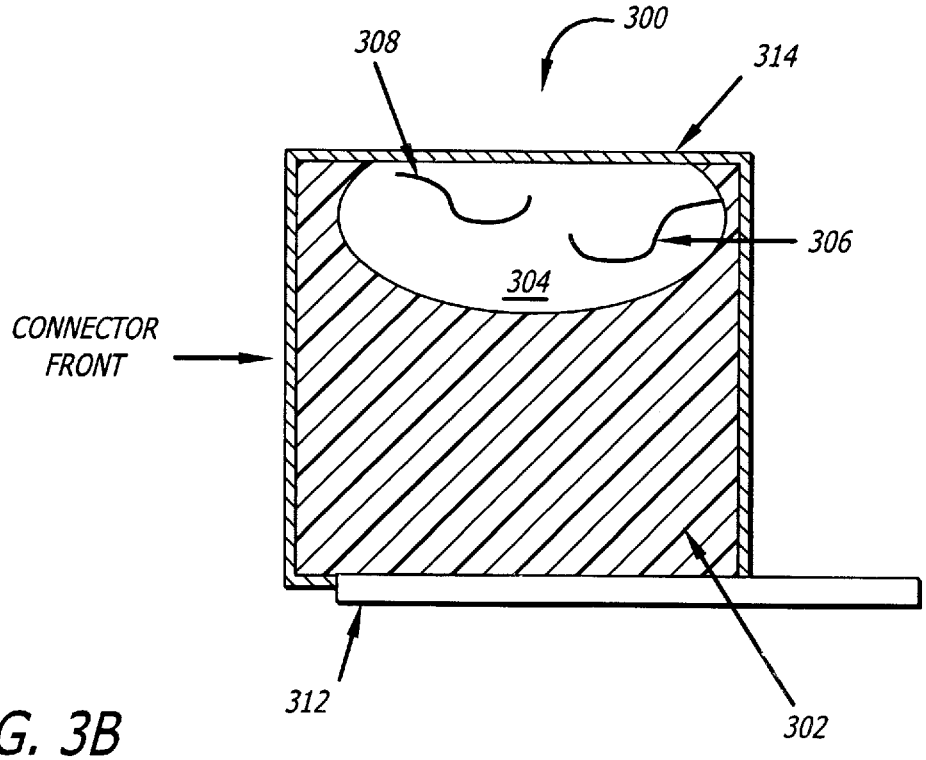

FIGS. 3A–B illustrate front and side views (with cut away view to show contacts) of an exemplary electrostatic protected connector 300 in accordance with the invention. The electrostatic protected connector 300 can be incorporated into a network equipment for connection to a network communication cable. As will be discussed in more detail, the connector 300 removes electrostatic charges build up on a network communications cable prior to the cable wire mediums making electrical contact to the contacts of the connector 300. As an additional option, the connector 300 can also prevent electrostatic charges from building on the cable wire mediums while the cable is connected to the connector 300.

The electrostatic protected connector 300 comprises a housing 302 having a cavity 304 for receiving therein a network cable connector. The connector 300 also comprises one or more contacts 306 situated within the cavity 304 that are electrically connected the network equipment hardware, and for electrical connection to the cable wire mediums when the cable is properly inserted into the connector 300. The connector 300 further comprises one or more electrostatic discharge contacts 308 for making electrical contact with the cable wire mediums for discharging electrostatic charge build up on the wire mediums. Optionally, the connector 300 may include panel mounts 310 on both sides of the housing 302 for mounting on electrical equipment panel. The connector 300 may also be optionally mounted on a PC board 312.

In the exemplary embodiment, the connector housing 302 is formed of a partially electrical conducting material, such as a plastic with an electrical conducting filler. For example, the housing 302 can have a resistivity of approximately 5 to 10 Mega Ohms per square area. Also in the exemplary embodiment, the outside of the connector housing 302 is coated with an electrical conductive shield 314 for electrical connection to ground potential. The connector housing 302 may be configured as a female RJ-45, RJ-11 or other suitable network connector types. The electrostatic discharge contacts 308 are also comprised of a partially electrical conducting material, such as a plastic with an electrical conducting filler. In the exemplary embodiment, the electrostatic discharge contacts 308 have a resistivity of approximately 5 to 20 Mega Ohms per square area.

In operation, when a network cable connector is initially being inserted into the electrostatic protected connector 300 of the invention, the contacts of the network cable connector make a momentarily electrical contact with the electrostatic discharge contacts 308 of the electrostatic protected connector 300. If there are any electrostatic charges on the cable wire mediums, the contacting of the cable connector contacts to the electrostatic discharge contacts 308 causes at least a substantial portion of the electrostatic charges on the wire mediums to discharge to ground potential by way of the electrostatic discharge contacts 308, connector housing 302, and the electrically conducting shield 314. After such a momentary contact, the cable connector continuous being inserted into the electrostatic protected connector 300 until the cable connector contacts make appropriate contact with the equipment contacts 306 of the connector 300. Since at least a substantial portion of the electrostatic charges on the cable has been discharged through the electrostatic discharge contacts 308, the network equipment hardware is better protected from damage due to electrostatic discharge coming from the network cable.

Figure 3C:
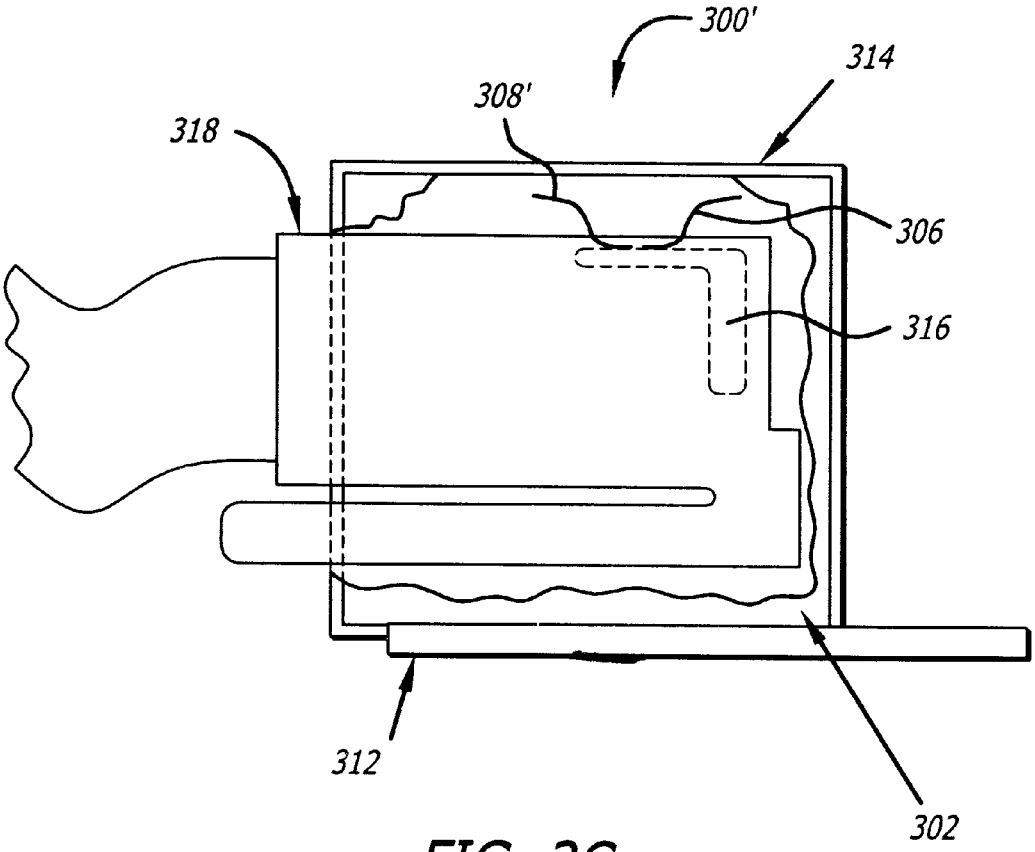
FIG. 3C illustrates a side view (with cut away view to show connector contacts and cable) of an exemplary electrostatic protected connector in accordance with the invention.

As an alternative embodiment as shown in FIG. 3C, the electrostatic discharge contacts 308' of the electrostatic protected connector 300' of the invention can be configured to make permanent contact with the network cable contacts 316 while the cable connector 318 is properly inserted in the electrostatic protected connector 300'. In this manner, the continuous contact of the electrostatic discharge contacts on the cable connector contacts prevent electrostatic charge build upon the cable while it is being used.

In the foregoing specification, the invention has been described with reference to specific embodiments thereof. It will, however, be evident that various modifications and changes may be made thereto departing from the broader spirit and scope of the invention. The specification and drawings are, accordingly, to be regarded in an illustrative rather than a restrictive sense.

It is claimed:

1. An electrostatic protected connector, comprising:

a housing having a cavity sized to receive therein a network 4 cable connector having one or more cable contacts;

one or more connector contacts situated within said cavity for electrical connection to said one or more cable contacts, wherein said one or more connector contacts are electrically connected to a network equipment hardware for transmitting data thereto; and one or more electrostatic discharge contacts for making lo electrical contact with said one or more cable contacts of the cable connector to discharge at least a portion of electrostatic charges on said one or more cable contacts, wherein said one or more electrostatic discharge contacts make contact with said one or more cable contacts when said one or more cable contacts make contact with said one or more connector contacts when said cable connector is fully inserted into said cavity wherein said one or more electrostatic discharge contacts each have a resistivity of approximately 5 Mega Ohms to 20 Mega Ohms per square area.

2. The electrostatic protected connector of claim 1, wherein said one or more electrostatic discharge contacts are situated within said cavity of said housing.

3. The electrostatic protected connector of claim 1, wherein said one or more electrostatic discharge contacts are positioned to contact said one or more cable contacts prior to said one or more cable contacts making contact to said one or more connector contacts as said network cable connector is being inserted into said cavity.

4. The electrostatic protected connector of claim 1, wherein said housing has a resistivity of approximately 5 Mega Ohms to 10 Mega Ohms per square area.

5. The electrostatic protected connector of claim 1, further comprising an electrically conductive coating disposed on an outside surface of said housing for making electrical connection to ground potential.

* * * * *